US008496547B2

(12) United States Patent
Wiley

(10) Patent No.: US 8,496,547 B2
(45) Date of Patent: Jul. 30, 2013

(54) COLLAPSIBLE GOAL POST FOR AMERICAN FOOTBALL

(76) Inventor: George Wiley, Monrovia, CA (US)

( * ) Notice: Subject to any disclaimer, the term of this patent is extended or adjusted under 35 U.S.C. 154(b) by 204 days.

(21) Appl. No.: 12/958,212

(22) Filed: Dec. 1, 2010

(65) Prior Publication Data

US 2012/0142457 A1 Jun. 7, 2012

(51) Int. Cl.
*A63B 63/00* (2006.01)

(52) U.S. Cl.
USPC ..... 473/477

(58) Field of Classification Search
USPC ..... 473/476, 472, 479, 484, 485, 486, 473/488, 447, 477, 415; 403/157; 241/101.763; 188/322.13; 114/90
See application file for complete search history.

(56) References Cited

U.S. PATENT DOCUMENTS

| | | | | |
|---|---|---|---|---|
| 2,480,572 | A | 8/1949 | Gronquist | |
| 3,466,723 | A * | 9/1969 | Durand | 29/897.33 |
| 3,847,488 | A * | 11/1974 | Gossage | 403/79 |
| 3,856,302 | A | 12/1974 | Karkoska | |
| 3,881,724 | A * | 5/1975 | Beveridge | 473/472 |
| 3,981,501 | A | 9/1976 | Gonzalez et al. | |
| 4,025,208 | A * | 5/1977 | Donahue | 403/157 |
| 4,026,554 | A | 5/1977 | Karkoska | |
| 4,465,277 | A | 8/1984 | Dittrich | |
| 4,801,142 | A | 1/1989 | Friesen | |
| 5,601,284 | A | 2/1997 | Blackwell et al. | |
| 6,302,811 | B1 | 10/2001 | Topham | |
| 6,394,917 | B1 | 5/2002 | Chiappini et al. | |
| 6,881,163 | B2 | 4/2005 | Schroeder et al. | |
| 6,945,885 | B2 | 9/2005 | Snider | |
| 7,014,578 | B1 * | 3/2006 | Brodeur | 473/477 |
| 7,252,605 | B2 | 8/2007 | Snider | |
| 7,407,453 | B2 * | 8/2008 | Shannon | 473/483 |
| 2002/0168258 | A1 * | 11/2002 | Philipps et al. | 414/462 |
| 2004/0166968 | A1 * | 8/2004 | Snider | 473/477 |
| 2005/0037875 | A1 * | 2/2005 | Snider | 473/477 |

OTHER PUBLICATIONS

YouTube Screen Shots, 2008, www.youtube.com/watch?v=Uro86C2q2no, 6 pages.*

* cited by examiner

*Primary Examiner* — Gene Kim
*Assistant Examiner* — M Chambers
(74) *Attorney, Agent, or Firm* — Christie, Parker & Hale, LLP

(57) ABSTRACT

A collapsible goal post includes a lower support extending from a playing field; a upper support having a first end and a second end, and a pivot assembly attaching the first end of the upper support to the lower support; an upper assembly comprising two uprights and a crossbar having two ends. The crossbar is attached to the second end of the support at about the midpoint of the crossbar. One of the two uprights is attached to each end of the crossbar. The upper support is configured to pivot about the pivot point assembly to move the upright assembly from a raised position to a lowered position. The two uprights are substantially perpendicular to the playing field in the raised position, and are substantially parallel to and contacting the playing field in the lowered position while the upper assembly and upper support remain attached to the lower support. In another embodiment, the goal post includes a hydraulic cylinder system coupled to the upper support and the lower support to hinder a rate of pivoting of the goal post about the pivot assembly.

20 Claims, 6 Drawing Sheets

212a
212b
324
326
320
322
330
114
112
110
356
364
354
360
365
274
275
271
272
273
216
424
279
212a
278c
278
276
422a
423
312
350
310
362
212b
360
112b
112a
340
114
421
408
110
410
412
412a
179
116
416a
174
178
176
178c
172
175

COLLAPSIBLE GOAL POST FOR AMERICAN FOOTBALL

BACKGROUND

This invention relates to a collapsible goal post that is suitable for use in American football.

A goal post in American football consists of a base connected to the playing field, a support attached to the base, a crossbar extending perpendicular from the support and parallel to the playing field, and an upright extending from either end of the crossbar. After many sporting games, it is common for fans and spectators to rush onto the field. In American football games in particular, spectators or vandals often climb onto and hang from the crossbar, support or other parts of the goal posts. Spectators falling from the goal posts may be injured or killed, or injuries or death can results from climbing spectators falling onto other spectators, players, officials, staff and others on the field. The goal posts are sometimes torn down by the spectators, which can also lead to injury and death to players, officials, staff, spectators and others on the field. It is also costly, time-consuming and otherwise bothersome to replace torn-down goalposts.

U.S. Pat. No. 6,945,885 describes an articulated football goal post having a crossbar and uprights that that can be pivoted to a raised game position and lowered to a second position. However, since the uprights are substantially vertical in both the raised and lowered positions, the uprights can still be climbed or torn down by spectators or vandals.

U.S. Pat. No. 7,252,605 describes an articulated football goal post having a crossbar and uprights that can be pivoted to a raised game position and lowered to a second position. In the second position, the uprights are substantially parallel to but suspended above the playing field. The second lowered position facilitates detachment of the crossbar and uprights. Although the detachment of the crossbar and uprights may prevent damage, the detachment process may be too slow to allow for complete detachment before the spectators rush onto the field. If removed by spectators or vandals, the uprights themselves may be moved, brandished, or otherwise handled in a manner that could cause injury or death to those on the field or in the area of the field. Furthermore, the detached crossbar and uprights must be completely removed from the field to prevent theft. The additional removal step is also time-consuming, and possibly even dangerous in a crowded situation.

SUMMARY

One embodiment of the present invention is directed toward a goal post for American football that is quickly, easily and safely lowered to the ground, making it impossible to climb on or otherwise forcibly tear down the goal post.

A goal post having a hinged pivot point is held in an upright position by a clevis pin locking device. To collapse the goal post, the pivot point is unlocked and gravity pulls the crossbar and uprights into a lowered position, wherein the crossbar and uprights are substantially parallel to and resting on the playing field.

In another embodiment, one or more hydraulic cylinders, for example double-acting hydraulic cylinders, regulate the speed of the lowering. The hydraulic cylinder may be situated on either side of the pivot point. The hydraulic cylinder allows the travel speed from the raised position to the lowered position to be adjustable. A pump connected to the hydraulic cylinder allows the goal post to be raised by the hydraulic cylinder. The one or more hydraulic cylinders may be removable in either the raised or lowered positions

BRIEF DESCRIPTION OF THE DRAWINGS

Further developments of the invention will stand out from a description of embodiments with reference to the drawings.

DETAILED DESCRIPTION

Figure 1:
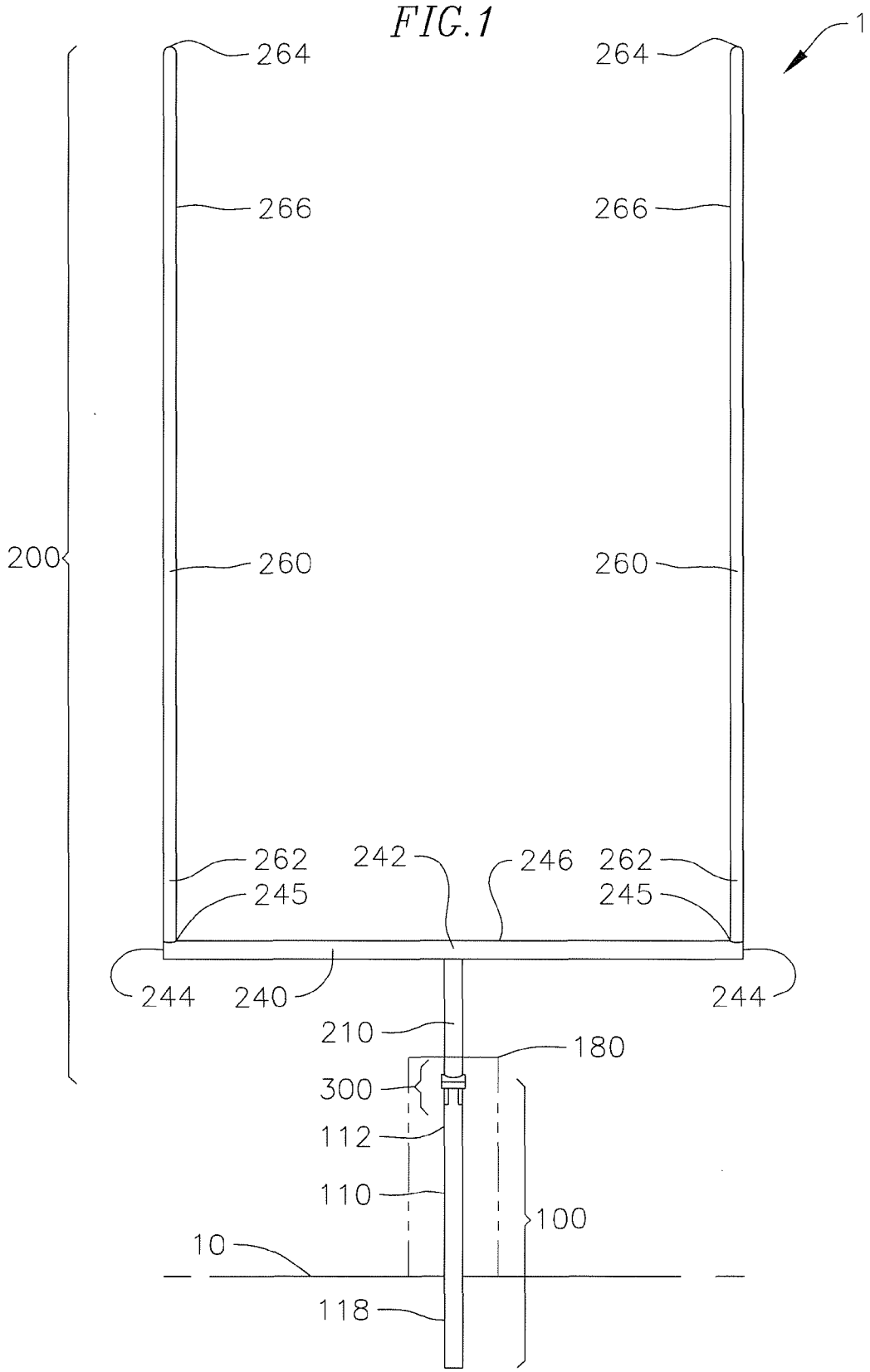
FIG. 1 shows a front schematic view of an embodiment of a goal post in a raised position.
Figure 2A:
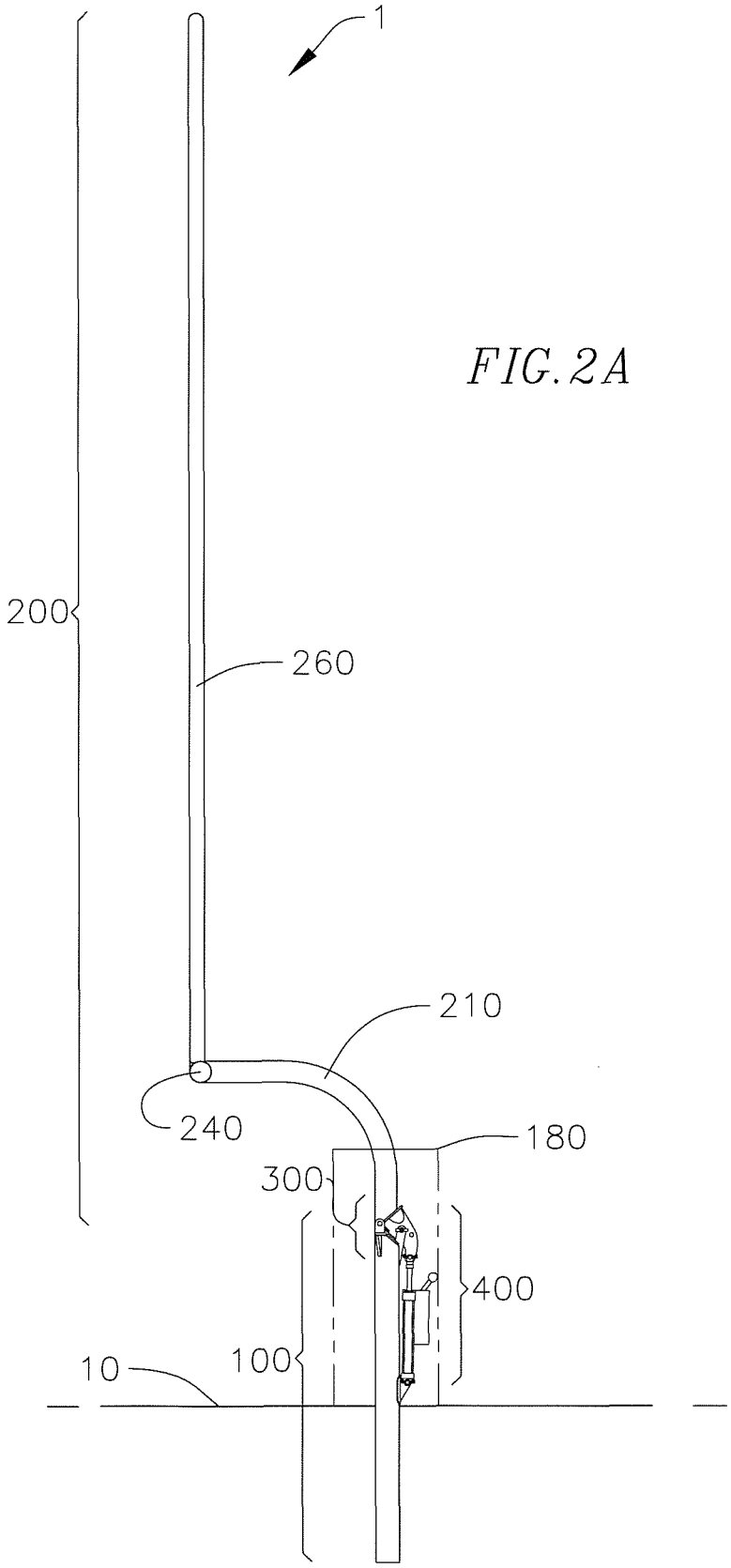
FIG. 2A shows a side schematic view of the goal post shown in FIG. 1 in the raised position.
Figure 2B:
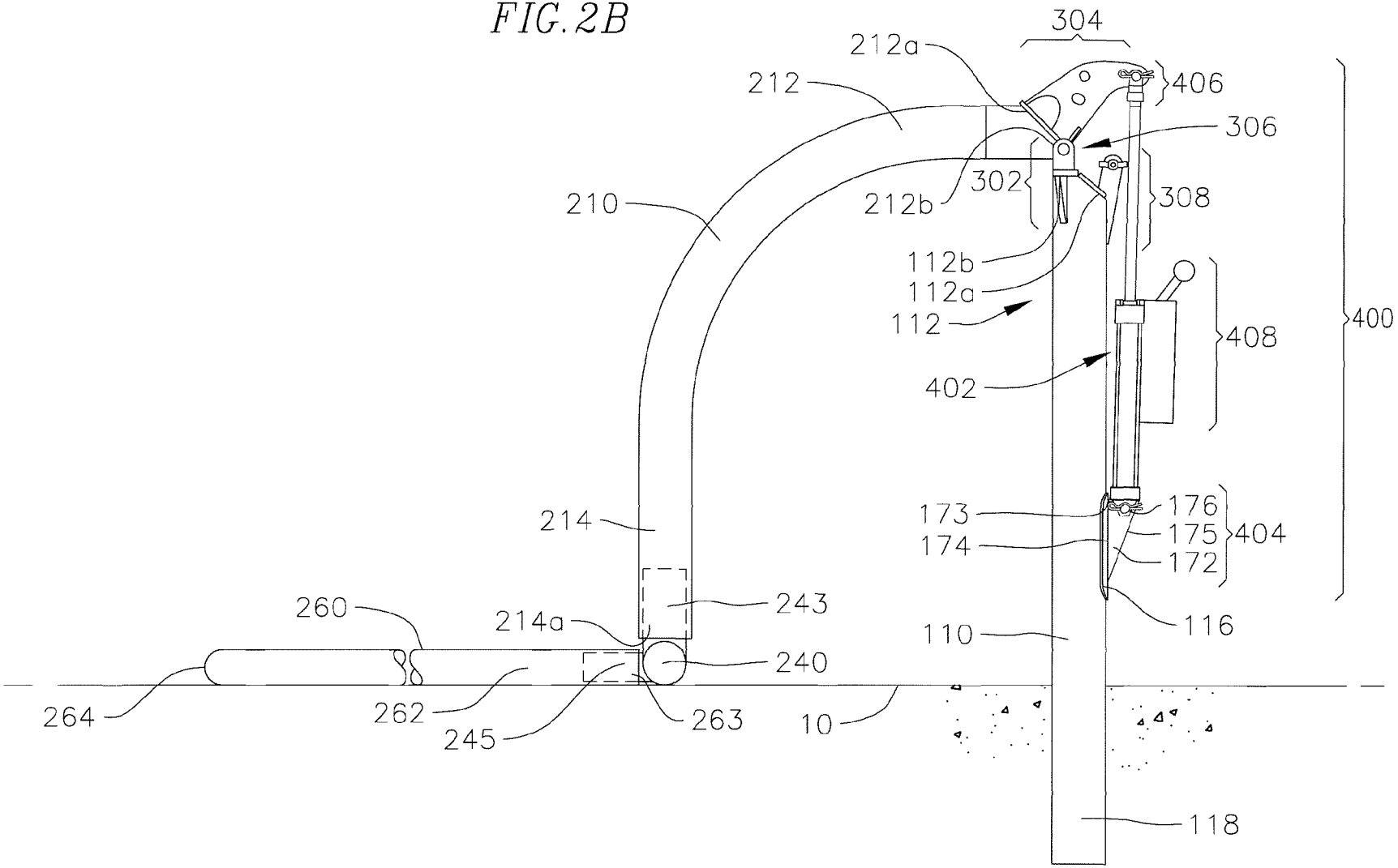
FIG. 2B shows a side schematic view of the goal post shown in FIG. 1 in a lowered position.

With regard to FIGS. 1, 2A and 2B, a goal post 1 includes a base portion assembly 100, an upper portion assembly 200, a pivot point assembly 300 connecting the base portion assembly 100 to the upper portion assembly 200, and a hydraulic assembly 400. The goal post 1 is pivotable from a raised position to a lowered position.

The base portion assembly 100 includes a lower support 110 and optionally a padding 180. A bottom portion 118 of the lower support 110 installed below the plane of a playing field 10 and attaches to an anchor assembly (not shown), separate from the base portion assembly 100. The anchor assembly may include hardware to secure the goal post 1 to the playing field 10. The lower support 110 extends substantially perpendicular from the playing field 10. A top portion 112 of the lower support 110 includes a beveled portion 112*a* and a horizontal portion 112*b*. The horizontal portion 112*b* is substantially perpendicular to the longitudinal axis of the lower support 110. The beveled portion 112*a* is at an angle to the horizontal portion 112*b*. The top portion 112 of the lower support 110 further includes parts of the pivot point assembly 300, which is described below.

The padding 180 covers the base portion assembly 100 in a circumferential direction from the playing field 10 to at least approximately 6 feet above the playing field 10. In one embodiment, the padding 180 is approximately 30 inches in diameter.

The upper portion assembly 200 includes a curved cylindrical support 210, a cylindrical crossbar 240 and two cylindrical uprights 260.

The curved support 210 includes a first end 212 and a second end 214. The first end 212 of the curved support 210 includes a beveled portion 212*a* and a flat portion 212*b*. The curved support 210 is attached to the lower support 110 by the pivot point assembly 300 at the first end 212. The second end 214 includes an open end forming a cavity 214*a*. The curved support 210 is curved such that the axis of the first end 212 and the axis of the second end 214 are substantially perpendicular.

The crossbar 240 has two ends 244, two end shanks 245, a top 246, a midpoint 242 and a midpoint shank 243. Each end shank 245 is a cylindrical segment smaller in diameter than and coaxial with the upright 260, and located near each of the ends 244. In one embodiment, each end shank 245 is welded to the crossbar 240. Each end shank 245 is substantially perpendicular to the longitudinal axis of the crossbar 240. The midpoint shank 243 is a cylindrical segment at about the midpoint 242 of the crossbar and extends substantially perpendicular to both the longitudinal axis of the crossbar and each of the two cavities 245. The second end 214 of the curved support 210 is attached to the crossbar 240 by inserting the midpoint shank 243 into the cavity 214*a* of the curved support 210. In one embodiment, the crossbar is cylindrical and 6 inches in diameter. In one embodiment, the top 246 of the crossbar 240 is 10 feet from the playing field 10 when the goal post 1 is in the raised position.

Each of the two uprights 260 includes a lower end 262, a lower end cavity 263, an upper end 264 and an inside 266. The lower end cavity 263 is a cylindrical cavity larger in diameter than the end shank 245 of the crossbar 240, and located at the lower end 262. One upright 260 is mounted to each of the two ends 244 of the crossbar 240 by inserting the shank 245 into the cavity 263 and securing the upright 260 with set screws (not shown). The two uprights 260 are substantially parallel to each other, and each is substantially perpendicular to the crossbar 240. In one embodiment, the inside 266 of each of the uprights 260 are spaced 18 feet and 6 inches from one another. In one embodiment, when the goal post 1 is in the raised position, the upper end 264 of the upright 260 is 40 feet above the playing field 10, which is the distance required by the National Football League ("NFL"). In another embodiment, when the goal post 1 is in the raised position, the upper end 264 of the upright 260 is 30 feet above the playing field 10, which is the minimum distance required by the National Collegiate Athletic Association ("NCAA"). In one embodiment, the diameter of each of the uprights 260 is 4 inches.

With reference to FIGS. 2B, 3A, 3B and 4, the pivot point assembly includes a base portion pivot assembly 302, an upper portion pivot assembly 304, a pivot pin assembly 306 and a locking assembly 308.

The base portion pivot assembly 302 includes a lower pivot bar 330, two lower pivot gussets 340, and two lower pivot knuckles 320 each having a bore 326.

The lower pivot bar 330 has two ends 332 and is a rectangular plate having a long axis slightly longer than the diameter of the lower support 110 and a short axis approximately the same width as the horizontal portion 112*b*. The lower pivot bar 330 is mounted on top of the horizontal portion 112*b* so that the two ends 332 of the lower pivot bar 330 extend beyond the sides of the lower support 110.

Each lower pivot gusset 340 is a plate in the shape of a right triangle having a short leg 342, a long leg 344 and a hypotenuse 346. One of the two lower pivot gussets 340 is mounted to the lower support 110 such that the long leg 344 is substantially parallel with the longitudinal axis of the lower support 110, the short leg 342 of the lower pivot gusset 340 extends substantially perpendicular to the longitudinal axis of the lower support 110, and the short leg 342 abuts one of the ends 332 of the lower pivot bar 330. The other lower pivot gusset 340 is mounted in substantially the same way, except that the short leg 342 abuts the other of the ends 332 of the lower pivot bar 330. The lower pivot gussets 340 serve to buttress the ends 332 of the lower pivot bar 330 that extend beyond the diameter of the lower support 110.

Each lower pivot knuckle 320 is a plate in the shape of an arched rectangle with a flat end 322 and an arched end 324. Each lower pivot knuckle 320 has a lower pivot knuckle bore 326 near the arched end 324. One lower pivot knuckle 320 is mounted on each of the ends 332 of the lower pivot bar 330 such that the two lower pivot knuckles 320 extend substantially parallel to the longitudinal direction of the lower support 110 and the two lower pivot knuckle bores 326 are coaxial.

The upper portion pivot assembly 304 includes an upper clevis plate mount plate 216, an upper clevis plate 272, and a pivot tube 220.

The upper clevis plate mount plate 216 is a D-shaped plate and is mounted on the end of the beveled portion 212*a* such that the flat side of the D abuts and is parallel to the flat portion 212*b*.

An upper clevis plate 272 is a fin-shaped plate having a flat end 271 and a tapered end 273 at an angle to the flat end 271. The flat end 271 is mounted to the upper clevis plate mount plate 216 such that the upper clevis plate 272 is substantially perpendicular to the upper clevis plate mount plate 216. The upper clevis plate 272 includes an upper clevis plate lock pin bore 274, an upper clevis plate rigging bore 275 and an upper clevis plate mount bore 276. The upper clevis plate rigging bore 275 is provided as a convenience to a ground crew installing, removing or maintaining the goal post 1. The upper clevis plate rigging bore 275 is approximately 1 inch in diameter, and is intended to be used in conjunction with an anchor shackle (not shown) as a rigging point, making it convenient to hoist the goal post 1 into and out of the ground.

Figure 4:
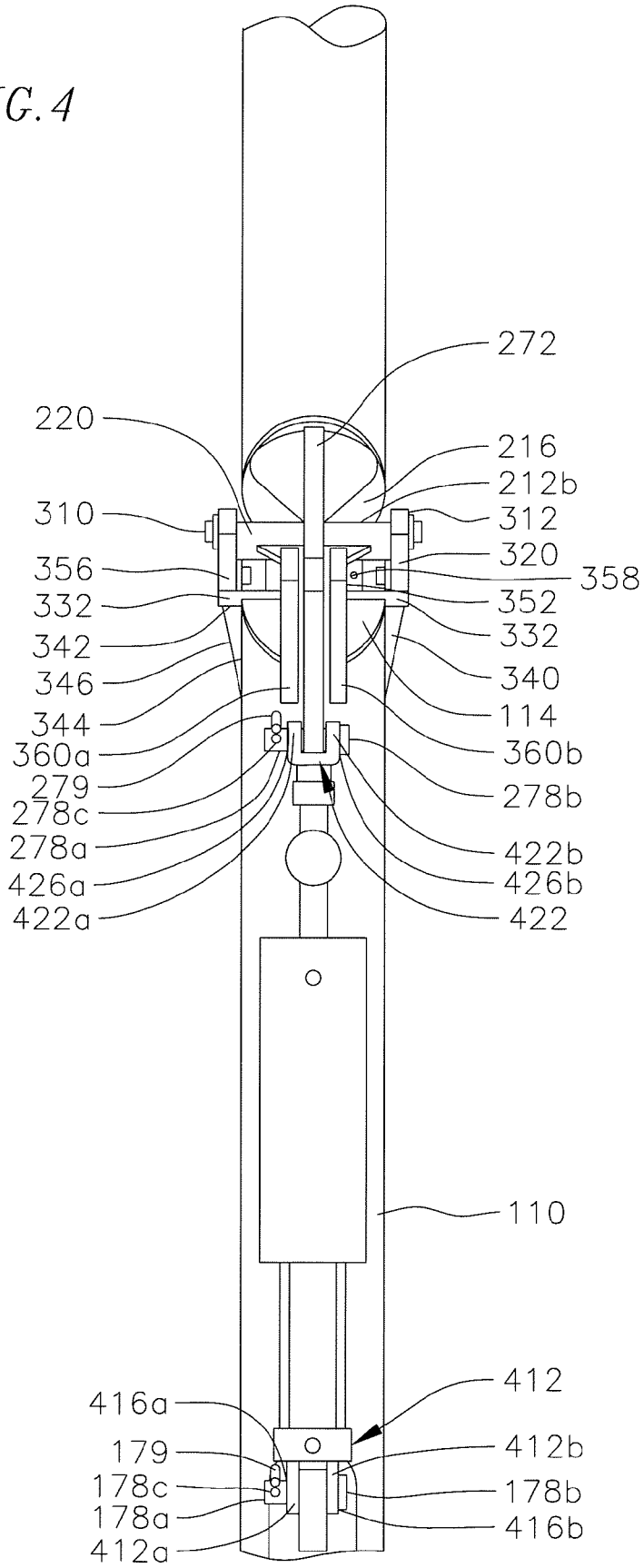
FIG. 4 is a close-up rear schematic view of the goal post shown in FIG. 1 in the raised position.

The pivot tube 220 defines a pivot tube bore (not shown). As shown in FIG. 4, the pivot tube 220 is welded to the flat portion 212*b* of the curved support 210.

The pivot pin assembly 306 includes a pivot pin 310 and optionally a pivot pin lock ring 312. The pivot pin 310 is a cylinder having a diameter small enough to fit within the lower pivot knuckle bores 326 and a length at least as long as the distance between the lower pivot knuckles 320. To accommodate the pivot pin lock ring 312, the pivot pin 310 also includes at least one groove (not shown). In one embodiment, pivot pin 310 includes two grooves, one on either side of the pivot pin 310. The grooves are positioned on the pivot pin 310 such that the grooves are spaced apart wider than the outside edges of the lower pivot knuckles 320.

The pivot pin lock ring 312 is a circular ring having an open section that is dimensioned to fit into one groove. When the lock ring 312 is positioned into the groove, the outside diameter of the pivot pin lock ring 312 is larger than the lower pivot knuckle bores 326. One pivot pin lock ring 312 is used for each groove.

Figures 3A, 3B:
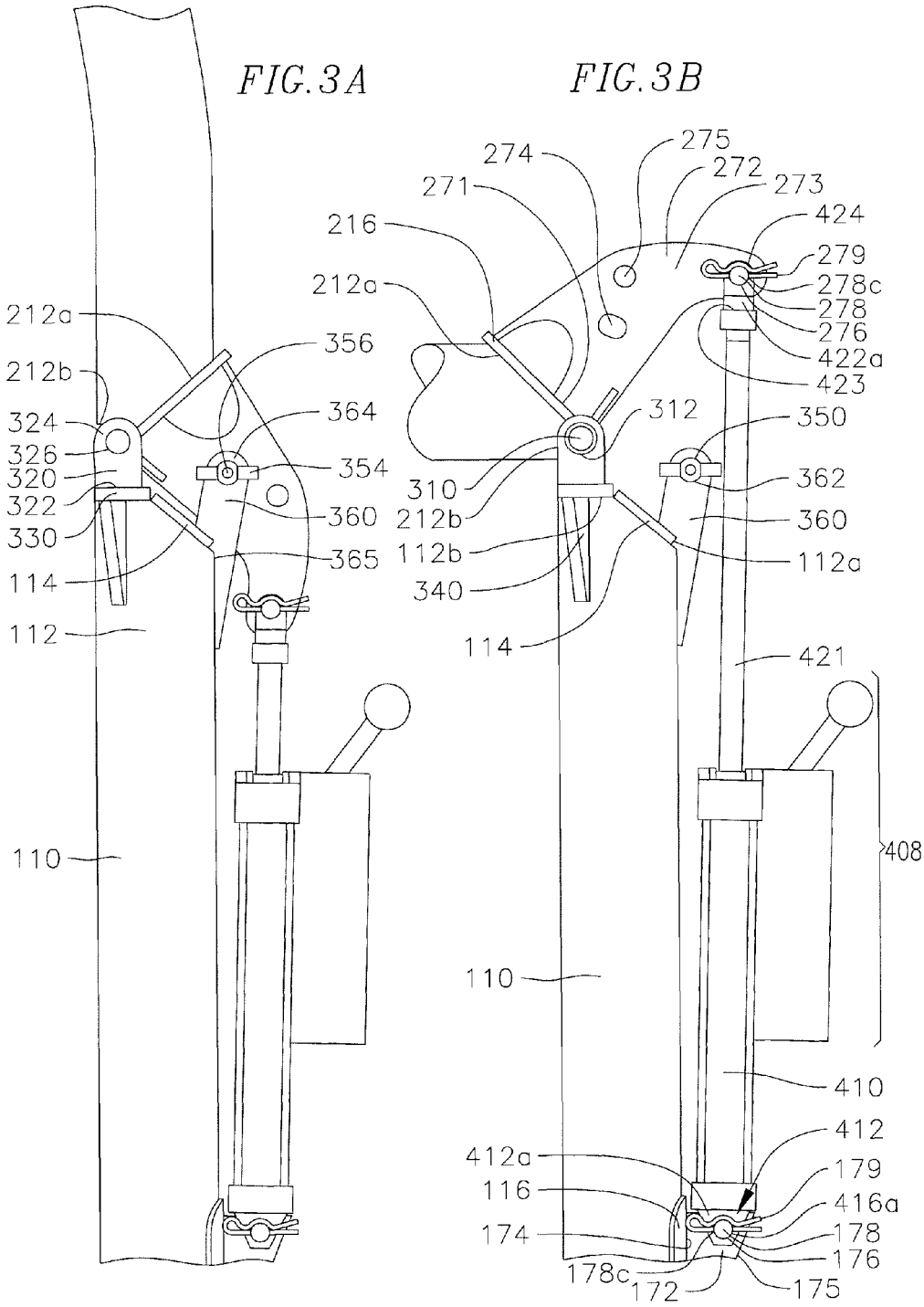
FIG. 3A is a close-up side schematic view of the goal post shown in FIG. 1 in the raised position.
FIG. 3B is a close-up side schematic view of the goal post shown in FIG. 1 in the lowered position.

With reference to FIGS. 2B, 3A and 3B, the locking assembly 308 includes a lower support cap plate 114, a lock pin clevis 360 having a bore 362, the lock pin bore 274 on the upper clevis plate 272, and a lock pin 350.

The lower support cap plate 114 is a D-shaped plate mounted on top of the beveled portion 112*a* of the lower support 110 such that the flat portion of the lower support cap plate 114 is close to and parallel to the pivot axis.

The lock pin clevis 360 includes two substantially parallel planar plates 360*a* and 360*b*. Each of the planar plates 360*a* and 360*b* have an arched rectangular shape having an arched short edge 364 and a contoured long edge 365 that fits the contours of the top portion 112 where the lower support cap plate 114 adjoins the lower support 110. The plates 360*a* and 360*b* are spaced apart to allow the upper clevis plate 272 to fit between them. In an alternative embodiment, the arched edge 364 of each of the plates 360*a* and 360*b* are spaced farther apart from one another than the contoured long edge 365 of each of the plates 360*a* and 360*b* for better guiding of the upper clevis plate 272 between the plates 360*a* and 360*b*. Each of the plates 360*a* and 360*b* have a lock pin clevis bore 362 near the arched short edge 364. The lock pin clevis 360 is mounted on top of the lower support 110 at an acute angle to the longitudinal axis of the lower support 110 and resting in part on the lower support cap plate 114.

The lock pin bore 274 on the upper clevis plate 272 is oval in shape with the smaller axis of the oval being approximately the same diameter as each of the lock pin clevis bores 362.

The lock pin 350 is T-shaped and includes a cylindrical shaft 352 and a cylindrical head 354 mounted perpendicular to the shaft 350 to form a T shape. The cylindrical shaft 350 is sized to fit within the lock pin bore 274 and the lock pin clevis bores 362. The lock pin 350 further includes a pushbutton 356 on the head 354 and a ball 358 on the shaft 352. The ball 358 prevents the shaft 352 from moving through the lock pin bore 274 and the lock pin clevis bores 362. When the pushbutton 356 is pushed, the ball 358 retracts into the shaft 352 so the lock pin 350 can be inserted through the lock pin bore 274 and the lock pin clevis bores 362.

As shown in FIG. 2B, the hydraulic assembly 400 includes a cylinder assembly 402, a lower mount assembly 404, an upper mount assembly 406 and a hydraulic control assembly 408.

Figure 5:
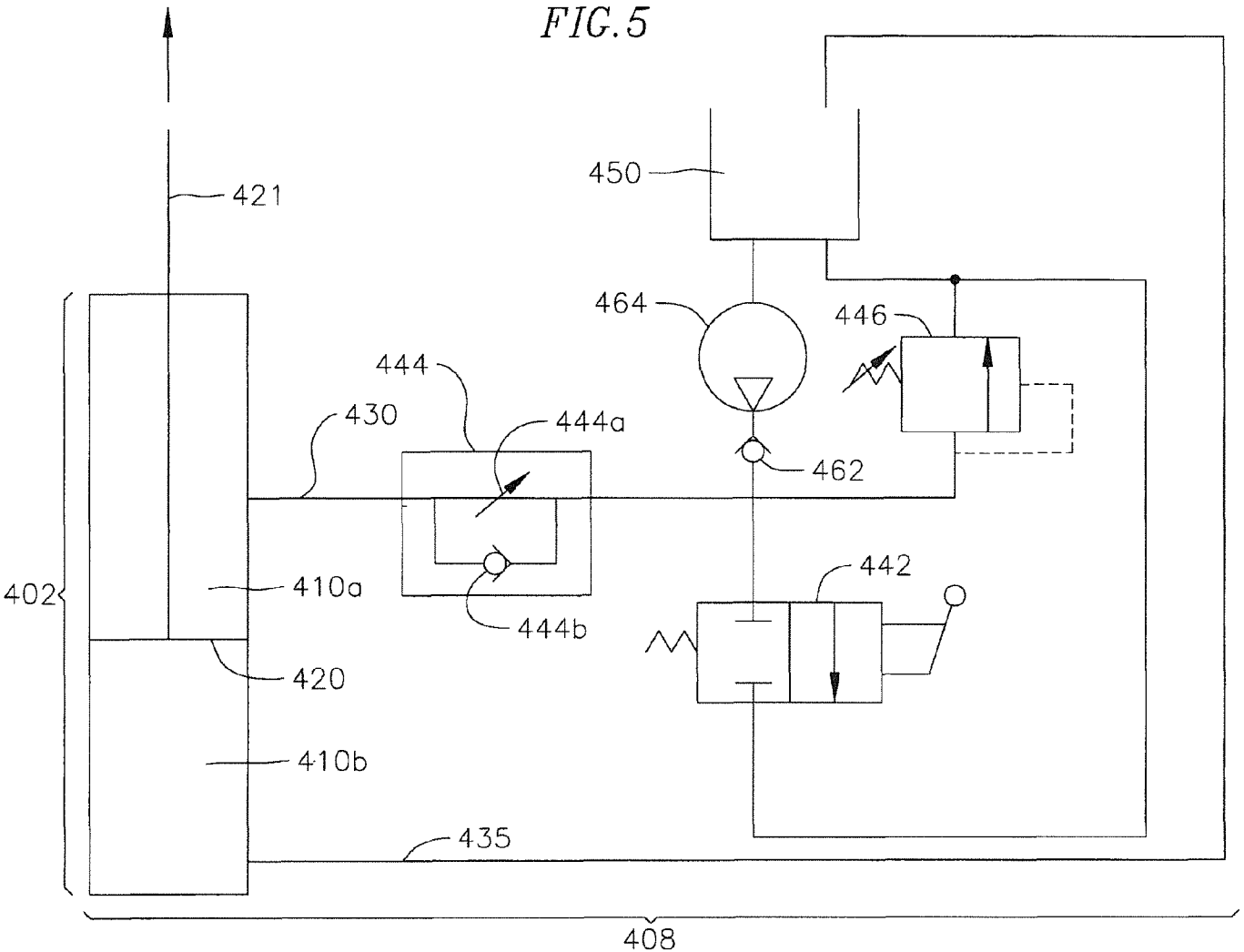
FIG. 5 is a schematic of the hydraulic system for the hydraulic cylinder.

With reference to FIGS. 3A, 3B and 5, the cylinder assembly 402 includes a hydraulic cylinder 410, a piston 420 and a piston rod 421. The piston 420 is within the hydraulic cylinder 410 and is connected to the piston rod 421, which can extend from and retract into the hydraulic cylinder 410 while the piston 420 traverses the length of the hydraulic cylinder 410. The piston rod 421 is substantially parallel to and coaxial with the hydraulic cylinder 410. The piston 420 divides the hydraulic cylinder 410 into an upper chamber 410*a* containing the piston rod 421, and a lower chamber 410*b*. The upper chamber 410*a* is filled with a hydraulic fluid (not shown), for example oil or any other suitable incompressible fluid. In one embodiment, the hydraulic fluid is Tellus® 46 oil from Shell (Houston, Tex.). The lower chamber 410*b* is filled with air and is connected by an air line 435 to a hydraulic fluid reservoir 450 above the fluid level to limit the amount of moisture or other contaminants from entering the lower chamber 410*b* of the hydraulic cylinder 410. In the case that hydraulic fluid or other liquids enter the lower chamber 410*b*, the connection to the reservoir 450 permits the moisture or liquid to flow to the reservoir 450 via the air line 435. As the piston rod 421 extends from the hydraulic cylinder 410, the piston 420 moves up such that the volume of the upper chamber 410*a* decreases and the volume of the lower chamber 410*b* increases.

With reference to FIGS. 3B and 4, the lower mount assembly 404 includes a lower clevis plate mount plate 116, a lower clevis plate 172 having a lower clevis plate mount bore 176, a cylinder clevis 412 having cylinder clevis mount bores 416*a* and 416*b*, and a lower mount clevis pin 178.

The lower clevis plate mount plate 116 is a curved plate that is mounted flush against the sidewall of the lower support 110. The lower clevis plate mount plate 116 is a doubler plate to strengthen the joint between the lower clevis plate 172 and the lower support 110.

The lower clevis plate 172 is a triangular plate having a short leg 173, a long leg 174 and a hypotenuse 175. The lower clevis plate 172 is mounted perpendicular to the lower clevis plate mount plate 116 along the long leg 174 such that the lower clevis plate 172 is substantially parallel to the longitudinal axis of the lower support 110 and the short leg 173 faces the top portion 112 of the lower support 110. The lower clevis plate 172 includes the lower clevis plate mount bore 176 near the short leg 173.

The hydraulic cylinder 410 has on an end opposite the piston rod 421 the cylinder clevis 412 that is substantially parallel to the longitudinal axis of the hydraulic cylinder 410. The cylinder clevis 412 is an integral part of the hydraulic cylinder 410 as supplied by the manufacturer. The cylinder clevis 412 includes two substantially parallel triangular plates 412*a* and 412*b* that are spaced to allow the lower clevis plate 172 to fit between them. Each of the parallel plates 412*a* and 412*b* include a cylinder clevis mount bore 416*a* and 416*b*, respectively. The cylinder clevis mount bores 416*a* and 416*b* are substantially the same diameter as the lower clevis plate mount bore 176.

The lower mount clevis pin 178 is cylindrical and includes a cylindrical shaft 178*a* and a head 178*b* mounted on one end of the shaft 178*a*. On an end opposite the head 178*b*, the shaft 178*a* has a bore 178*c*. The bore 178*c* is substantially perpendicular to the longitudinal axis of the shaft 178*a*. A lower mount cotter pin 179 is a length of wire bent into shape resembling a capital letter "R". The straight leg of the cotter pin 179 fits in the bore 178*c*. The bent leg of the lower mount cotter pin 179 grips the side of the shaft 178*a*. The cylindrical shaft 178*a* is sized to fit within the lower clevis plate mount bore 176 and the cylinder clevis mount bores 416*a* and 416*b*. The cotter pin 179 and the head 178*b* are sized such that the lower mount clevis pin 178 cannot be removed from the lower clevis plate mount bore 176 and the cylinder clevis mount bores 416*a* and 416*b* when the cotter pin 179 is placed in the bore 178*c*.

The upper mount assembly 406 includes the upper clevis plate mount bore 276 on the upper clevis plate 272, a piston clevis 422 having piston rod mount bores 426*a* and 426*b*, and an upper mount clevis pin 278.

The piston clevis 422 is attached to an end of the piston rod 421 opposite the hydraulic cylinder 410. The piston clevis 422 is a single, forged piece that threads onto the piston rod 421, and is typically provided by the manufacturer. The piston clevis 422 is substantially parallel to the longitudinal axis of the piston rod 421. The piston clevis 422 includes two substantially parallel plates 422*a* and 422*b* that are shaped like arched rectangles, each having a flat end 423 and an arched end 424. The parallel plates 422*a* and 422*b* are spaced to allow the upper clevis plate 272 to fit between them. The parallel plates 422*a* and 422*b* are mounted to the piston rod 421 at the flat end 423. Each of the parallel plates 422*a* and 422*b* include a piston clevis mount bore 426*a* and 426*b*, respectively, near the arched end 424.

The upper mount clevis pin 278 is cylindrical and includes a cylindrical shaft 278*a* and a head 278*b* mounted on one end of the shaft 278*a*. On an end opposite the head 278*b*, the shaft 278*a* has a bore 278*c*. The bore 278*c* is substantially perpendicular to the longitudinal axis of the shaft 278*a*. An upper mount cotter pin 279 is a length of wire bent into shape resembling a capital letter "R". The straight leg of the cotter pin 279 fits in the bore 278*c*. The bent leg of the lower mount cotter pin 279 grips the side of the shaft 278*a*. The cylindrical shaft 278*a* is sized to fit within the upper clevis plate mount bore 276 and the piston clevis mount bores 426*a* and 426*b*. The cotter pin 279 and the head 278*b* are sized such that the upper mount clevis pin 278 cannot be removed from the upper clevis plate mount bore 276 and the piston clevis mount bores 426*a* and 426*b* when the cotter pin 279 is placed in the bore 278*c*.

With reference to FIG. 5, the hydraulic control assembly 408 includes a hydraulic line 430, the air line 435, and actuator valve 442, an adjustable valve 444, a safety valve 446, the hydraulic fluid reservoir 450, a ball check valve 462 and a gear pump 464.

The hydraulic line 430 is tubing and/or piping that connects the upper chamber 410*a* to the reservoir 450. Other components of the hydraulic control assembly 408 including the actuator valve 442, adjustable valve 444, safety valve 446, one way valve 462 and gear pump 464 are connected between the upper chamber 410*a* and the reservoir 450 by the hydraulic line 430.

The air line 435 is tubing and/or piping that connects the lower chamber 410*b* directly to the airspace above the fluid in the reservoir 450.

The adjustable valve 444 is connected between the upper chamber 410*a* and three components connected in parallel between the adjustable valve 444 and the reservoir 450. The three components include the actuator valve 442 for lowering the upper portion assembly 200, the gear pump 464 for raising the upper portion assembly 200, and a safety valve 446.

The adjustable valve 444 includes an adjustable orifice 444*a* and a ball check valve 444*b*. The adjustable orifice 444*a* is an opening that is adjustable in size, which effectively meters the rate at which the hydraulic fluid can flow from the upper chamber 410*a* through the adjustable valve 444. The ball check valve 444*b* allows fluid to flow freely into the upper chamber 410*a* from the gear pump 464.

The actuator valve 442 is a spring-loaded valve that, when actuated, allows fluid to flow from the upper chamber 410*a* to the reservoir 450. When the actuator 442 is released, the spring-loaded valve automatically shuts and all fluid flow ceases. The piston 420 does not and cannot extend and thus lower the upper portion assembly 200 when the actuator 442 is not actuated. Additionally, holding the actuator valve 442 in the open position will prevent the gear pump from raising the upper portion assembly 200.

The safety valve 446 is an integral part of the actuator valve 442. In the event that hydraulic pressure in the upper chamber 410*a* exceeds a pre-determined pressure, hydraulic fluid will flow from the upper chamber 410*a* through the adjustable valve 444 and the safety valve into the reservoir 450. This is a safety feature, designed to prevent damage to the goal post 1, including the hydraulic assembly 400.

Between the gear pump 464 and the adjustable valve 444 is a one way valve 462, which allows hydraulic fluid to flow from the gear pump 464 to the upper chamber 410*a*, but not from the upper chamber 410*a* to the gear pump 464. In one embodiment, the one way valve 462 is a ball check valve. The gear pump 464 acts to move fluid from the reservoir 450 through the one way valve 462 to the upper chamber 410*a*, and therefore retract the piston rod 421 into the hydraulic cylinder 410. In one embodiment, the pump 464 is a gear pump that is operated by a battery powered hand held drill or a manual crank handle.

The hydraulic fluid reservoir 450 stores the hydraulic fluid flowing from the upper chamber 410*a* and air flowing from the lower chamber 410*b*. The reservoir 450 is open to the atmosphere via a vented fluid fill cap (not shown) located at the top of the reservoir 450. This design limits the amount of moisture or other contaminants entering the hydraulic assembly 400.

An enclosure (not shown) made of sheet metal may be formed around the hydraulic assembly 400 to facilitate removal and handling of the hydraulic assembly and also for aesthetic and safety purposes.

The assembly of the goal post 1 will now be described with reference to FIGS. 2A, 2B, 3A, 3B, 4 and 5.

To connect the upper portion assembly 200 to the base portion assembly 100, the pivot tube 220 is positioned between the two lower pivot knuckles 320, with the pivot tube bore aligned with the two lower pivot knuckle bores 326. The pivot pin 310 is inserted through the two lower pivot knuckle bores 326 and the pivot tube bore, such that the two grooves 311 remain exposed. One of the two locking rings 312 is positioned into each of the two grooves 311 to lock the pivot pin 310 in place.

To mount the piston rod 421 to the curved support 210, the upper clevis plate 272 is inserted into the piston clevis 422, and the upper clevis plate mount bore 276 is aligned with the piston clevis mount bores 426*a* and 426*b*. The shaft 278*a* of an upper mount clevis pin 278 is inserted through all three mount bores 276, 426*a* and 426*b*. The cotter pin 279 is then inserted through the bore 278*c* of the upper mount clevis pin 278.

To mount the hydraulic cylinder 410 to the lower support 110, the lower clevis plate 172 is inserted into the cylinder clevis 412, and the lower clevis plate mount bore 176 is aligned with the cylinder clevis mount bores 416*a* and 416*b*. The shaft 178*a* of the lower mount clevis pin 178 is inserted through all three mount bores 176, 416*a* and 416*b*. The cotter pin 179 is then inserted through the bore 178*c* of the lower mount clevis pin 178.

Because the hydraulic fluid is incompressible, the upper chamber 410*a* must allow hydraulic fluid to escape in order for the upper chamber 410*a* to decrease in volume. Likewise, the lower chamber 410*b* must allow air to enter in order for the lower chamber 410*b* to increase in volume. This is accomplished by connecting the upper chamber 410*a* to the reservoir 450 by the hydraulic line 430 via the adjustable valve 444, the actuator valve 442 and the safety valve 446; and the lower chamber 410*b* to the reservoir 450 by the air line 435.

When the goal post 1 is in the raised position, as shown in FIGS. 1, 2A, 3A and 4, the first end 212 of the curved support 210 is substantially perpendicular to the playing field 10, and the second end 214 is substantially parallel to the playing field 10. When the goal post 1 is in the lowered position, the first end 212 is substantially parallel to the playing field 10, and the second end 214 is substantially perpendicular to the playing field 10. In one embodiment, when the goal post 1 is in the lowered position, as shown in FIGS. 2B and 3B, each of the uprights 260 and the crossbar contact the playing field 10.

When the goal post 1 is in the raised position, the upper clevis plate lock pin bore 274 aligns with each of the lock pin clevis bores 362. The T-shaped lock pin 350 is inserted through all three bores to maintain the goal post 1 in the raised position.

To collapse the goal post 1 from the raised position to the lowered position, the pump 464 is actuated to drive hydraulic fluid from the reservoir 450 through the pump 464, the ball check valve 462 and the ball check valve 444*b* to the upper chamber 410*a*. This moves the piston 420 down to increase the volume of the upper chamber 410*a*, which in turn retracts the piston rod 421 farther into the hydraulic cylinder 410. This retraction pulls the upper portion assembly 200 farther into a raised position, which unloads the lock pin 350 for easier removal from the lock pin clevis bores 362 and the upper clevis plate lock pin bore 274. The oval shape of the lock pin bore 274 allows the lock pin 350 to be more easily removed. After the lock pin 350 is removed, the force of gravity acts to pivot the upper portion assembly 200 toward the playing field 10 until the uprights 260 rest on the playing field 10.

However, when the hydraulic assembly 400 is mounted to the goal post 1, the curved support 210 is attached to the piston rod 421 and the lower support 110 is attached to the hydraulic cylinder 410. The upper portion assembly 200 therefore does not and cannot pivot about the pivot point assembly 300 unless the actuator 442 is actuated to allow the hydraulic fluid to move from the upper chamber 410*a* through the orifice 444*a* and the actuator 442 to the reservoir, thereby allowing the piston 420 to move and the piston rod 421 to extend out of the hydraulic cylinder 410. The adjustable valve 444 can be adjusted to control the rate at which the upper portion assembly 200 lowers.

Because the actuator 442 does not allow the upper portion assembly 200 to pivot unless the actuator 442 is actuated, this is referred to as a "dead man" operation. If an operator lets go of the actuator 442, the spring-loaded valve will close and all motion of the goal post 1 will cease.

To raise the goal post 1 from the lowered position to the raised position, resistance from the hydraulic cylinder 410 and piston 420 should be minimized. This can be accomplished by removing the hydraulic assembly 400 and raising the upper portion assembly 200 manually. The upper portion assembly 200 can then be raised manually by grasping any part of the upper portion assembly 200 and hoisting the goal post 1 into the raised position. Alternatively, the upper portion assembly 200 can be raised by any other method.

In another embodiment, the pump 464 can provide a hydraulic assist to raise the upper portion assembly 200. The pump 464 is actuated to drive hydraulic fluid from the reservoir 450 through the pump 464, the ball check valve 462 and the ball check valve 444*b* to the upper chamber 410*a*. This moves the piston 420 down to increase the volume of the upper chamber 410*a*, which in turn retracts the piston rod 421 farther into the hydraulic cylinder 410. This retraction pulls the upper portion assembly 200 farther into a raised position To remove the hydraulic assembly 400, the upper mount clevis pin 278 and the lower mount clevis pin 178 are removed. The upper mount cotter pin 279 is removed from the bore 278*c*. Then, the upper mount clevis pin 278 is removed from the piston clevis mount bores 424*a* and 424*b* and the upper clevis plate mount bore 274, which allows the upper clevis plate 272 to be removed from the piston clevis 422, and therefore uncouple the piston rod 421 from the curved support 210. The lower mount cotter pin 179 is removed from the bore 178*c*. Then, the lower mount clevis pin 178 is removed from the cylinder clevis mount bores 416*a* and 416*b* and the lower clevis plate mount bore 176, which allows the lower clevis plate 172 to be removed from the cylinder clevis 412, and therefore uncouple the hydraulic cylinder 410 from the lower support 110. Once the upper portion assembly is raised, manually or otherwise, the upper clevis plate 272 is inserted between the parallel plates 360*a* and 360*b* of the lock pin clevis 360. The upper clevis plate lock pin bore 274 is aligned with the lock pin clevis bores 362, and the shaft 352 of the lock pin 350 is inserted through all three lock pin bores.

The hydraulic assembly 400 can be removed when the upper portion assembly 200 is in either the raised or lowered positions. The hydraulic assembly 400 would typically be removed when the upper portion assembly 200 is in the raised position. However, the hydraulic assembly 400 would be removed when the upper portion assembly 200 is in the lowered position to facilitate removal of the goal post 1 from the playing field 10, as frequently occurs when the stadium is used for other sporting events such as soccer, or for other events such as concerts.

While a particular form of the invention has been illustrated and described, it will be apparent that various modifications can be made without departing from the spirit and scope of the invention. For example, different mounting and locking mechanisms may be employed, the hydraulic line 430 may have a different configuration or different components, or the dimensions of the goal post may be changed. Accordingly, it is not intended that the invention may be limited except by the appended claims.

What is claimed is:

1. A collapsible goal post comprising:

a lower support extending from a playing field, a top portion of the lower support including a first beveled portion;

an upper support having a first end and a second end, the first end of the upper support including a second beveled portion, wherein a pivot assembly attaches the first end of the upper support to the lower support;

an upper assembly comprising two uprights and a crossbar having two ends, wherein the crossbar is attached to the second end of the upper support at about the midpoint of the crossbar, and one of the two uprights is attached to each end of the crossbar; and a hydraulic cylinder system coupled to the upper support and the lower support to hinder a rate of pivoting of the goal post about the pivot assembly, wherein the upper support is configured to pivot about the pivot assembly to move the upper assembly from a raised position to a lowered position, wherein the two uprights are substantially perpendicular to the playing field in the raised position, wherein the two uprights are substantially parallel to and contacting the playing field in the lowered position while the upper assembly and upper support remain attached to the lower support, wherein the hydraulic cylinder system comprises a hydraulic cylinder, a piston and a piston rod, wherein the hydraulic cylinder is attached to one of the lower support and the upper support and the piston rod is attached to the other of the lower support and the upper support, wherein the goal post is maintained in the raised position by a locking device, and wherein the locking device comprises a locking clevis pin setup comprising a locking clevis plate attached to the upper support, a locking clevis attached to the lower support, and a locking clevis pin.

2. The collapsible goal post according to claim 1, wherein the piston rod is extended when the goal post is in the lowered position.

3. The collapsible goal post according to claim 1 wherein the hydraulic cylinder system further comprises a pump to allow the hydraulic cylinder to pivot the goal post from the lowered position to the raised position.

4. The collapsible goal post according to claim 1 wherein the hydraulic cylinder system is releasably connected to the goal post.

5. The collapsible goal post according to claim 4 wherein the hydraulic cylinder system is releasably connected to the goal post by at least one clevis pin setup.

6. The collapsible goal post according to claim 1 wherein the hydraulic cylinder system further comprises a variable valve coupled to the hydraulic cylinder to adjust the flow of hydraulic fluid from the hydraulic cylinder such that the rate of pivoting of the goal post is adjustable.

7. A collapsible goal post comprising:

a lower support comprising a top portion of the lower support having a first beveled portion;

an upper support comprising a first end of said upper support including a second beveled portion, wherein a pivot assembly attaches the first end of the upper support to the lower support;

an upper assembly comprising two uprights and a crossbar having two ends, wherein the crossbar is attached to a second end of the upper support at about the midpoint of the crossbar, and one of the two uprights is attached to each end of the crossbar; and a hydraulic cylinder system coupled to the upper support and the lower support to hinder a rate of pivoting of the goal post about the pivot assembly, wherein the upper support is configured to pivot about the pivot assembly to move the upper assembly from a raised position to a lowered position, wherein the two uprights are substantially perpendicular to a playing field in the raised position, wherein the two uprights are substantially parallel to and contacting the playing field in the lowered position while the upper assembly and upper support remain attached to the lower support, wherein the hydraulic cylinder system comprises a hydraulic cylinder, a piston and a piston rod, wherein the hydraulic cylinder is attached to one of the lower support and the upper support and the piston rod is attached to the other of the lower support and the upper support, wherein the goal post is maintained in the raised position by a locking device, and wherein the locking device comprises a locking clevis pin setup comprising a locking clevis plate attached to the upper support, a locking clevis attached to the lower support, and a locking clevis pin, wherein the hydraulic cylinder system is movable from an attached position to a detached position when the upper assembly is in either the raised position or the lowered position, wherein the hydraulic cylinder system is coupled to the upper support at the second fastening point and the lowe ort at the first fastening point in the attached position and wherein the hydraulic cylinder system is uncoupled from the upper support and lower support in the detached position.

8. A method of moving the collapsible goal post of claim 1, the method comprising:

defeating the locking device, allowing the uprights to pivot on the pivot assembly and rest on the playing field in the lowered position while the upper assembly and upper support remain attached to the lower support.

9. The method of moving a collapsible goal post of claim 8, the method further comprising:

pivoting the crossbar and uprights to the raised position, and engaging the locking device.

10. The method of raising a collapsible goal post of claim 9, the collapsible goal post comprising:

the hydraulic cylinder releasably mounted to the lower support by a lower mount clevis pin, the piston rod releasably mounted to the upper support by an upper mount clevis pin, wherein the piston rod is extended from the hydraulic cylinder when the goal post is in the lowered position and retracted into the hydraulic cylinder when the goal post is in the raised position, and a variable valve, the method further comprising:

removing the hydraulic cylinder from the lower support by removing the lower mount clevis pin and removing the piston rod from the upper support by removing the upper mount clevis pin when the goal post is in the lowered position, manually pivoting the crossbar and uprights to the raised position, and placing the locking clevis pin into the locking clevis and the locking clevis plate to engage the locking device when the goal post is in the raised position.

11. The method of raising a collapsible goal post of claim 10, the method further comprising mounting the hydraulic cylinder to the lower support by installing the lower mount clevis pin and mounting the piston rod to the upper support by installing the upper mount clevis pin when the goal post is in the raised position and when the locking clevis pin is placed into the locking clevis and the locking clevis plate.

12. The method of raising a collapsible goal post of claim 9, the collapsible goal post comprising:

the hydraulic cylinder attached to the lower support, the hydraulic cylinder comprising a variable volume chamber filled with hydraulic fluid, the piston rod attached to the upper support, wherein the piston rod changes position when the variable volume chamber changes volume, and is extended from the hydraulic cylinder when the goal post is in the lowered position and retracted into the hydraulic cylinder when the goal post is in the raised position, a variable valve, and a pump, the method further comprising:

actuating the pump to pump hydraulic fluid into the variable volume chamber to retract the piston rod into the hydraulic cylinder to pivot the crossbar and uprights to the raised position, and placing the locking clevis pin into the locking clevis and the locking clevis plate to engage the locking device.

13. The method of collapsing a collapsible goal post of claim 8, the collapsible goal post comprising:

the hydraulic cylinder releasably mounted to the lower support by a lower mount clevis pin, the piston rod releasably mounted to the upper support by an upper mount clevis pin, wherein the piston rod is extended from the hydraulic cylinder when the goal post is in the lowered position and retracted into the hydraulic cylinder when the goal post is in the raised position, and a variable valve, the method further comprising:

removing the locking clevis pin from the locking clevis and the locking clevis plate to defeat the locking device, adjusting the variable valve to control the rate at which the piston rod extends from the hydraulic cylinder, which in turn controls the rate at which the goal post pivots on the pivot assembly.

14. The method of collapsing a collapsible goal post of claim 13, the method further comprising removing the hydraulic cylinder from the lower support by removing the lower mount clevis pin and removing the piston rod from the upper support by removing the upper mount clevis pin when the goal post is in the lowered position.

15. The method of collapsing a collapsible goal post of claim 8, the collapsible goal post comprising:

the hydraulic cylinder attached to the lower support, the piston rod attached to the upper support, wherein the piston rod is extended from the hydraulic cylinder when the goal post is in the lowered position and retracted into the hydraulic cylinder when the goal post is in the raised position, and a variable valve, the method further comprising:

removing the locking clevis pin from the locking clevis and the locking clevis plate to defeat the locking device, and adjusting the variable valve to control the rate at which the piston rod extends from the hydraulic cylinder, which in turn controls the rate at which the goal post pivots on the pivot assembly.

16. A. method of moving the collapsible goal post of claim 7, the method comprising:

defeating the locking device, allowing the uprights to pivot on the pivot assembly and rest on the playing field in the lowered position while the upper assembly and upper support remain attached to the lower support.

17. The method of moving a collapsible goal post of claim 16, the method further comprising:

pivoting the crossbar and uprights to the raised position, and engaging the locking device.

18. The method of raising a collapsible goal post of claim 17, the collapsible goal post comprising:

the hydraulic cylinder releasably mounted to the lower support by a loo c pin, the piston rod releasably mounted to the upper support by an upper mount clevis pin, wherein the piston rod is extended from the hydraulic cylinder when the goal post is in the lowered position and retracted into the hydraulic cylinder when the goal post is in the raised position, and a variable valve, the method further comprising:

removing the hydraulic cylinder from the lower support by removing the lower mount clevis pin and removing the piston rod from the upper support by removing the upper mount clevis pin when the goal post is in the lowered position, manually pivoting the crossbar and uprights to the raised position, and placing the locking clevis pin into the locking clevis and the locking clevis plate to engage the locking device when the goal post is in the raised position.

19. The method of raising a collapsible goal post of claim 18, the method further comprising mounting the hydraulic cylinder to the lower support by installing the lower mount clevis pin and mounting the piston rod to the upper support by installing the upper mount clevis pin when the goal post is in the raised position and when the locking clevis pin is placed into the locking clevis and the locking clevis plate.

20. The method of collapsing a collapsible goal post of claim 16, the collapsible goal post comprising:

the hydraulic cylinder attached to the lower support, the piston rod attached to the upper support, wherein the piston rod is extended from the hydraulic cylinder when the goal post is in the lowered position and retracted into the hydraulic cylinder when the goal post is in the raised position, and a variable valve, the method further comprising:

removing the locking clevis pin from the locking clevis and the locking clevis plate to defeat the locking device, and adjusting the variable valve to control the rate at which the piston rod extends from the hydraulic cylinder, which in turn controls the rate at which the goal post pivots on the pivot assembly.

* * * * *

UNITED STATES PATENT AND TRADEMARK OFFICE

CERTIFICATE OF CORRECTION

PATENT NO. : 8,496,547 B2
APPLICATION NO. : 12/958212
DATED : July 30, 2013
INVENTOR(S) : George Wiley It is certified that error appears in the above-identified patent and that said Letters Patent is hereby corrected as shown below:

In the Claims

| | |
|---|---|
| Column 11, Claim 7, line 33 | Delete "lowe ort"<br>Insert -- lower support -- |
| Column 13, Claim 18, line 19 | Delete "loo c pin,"<br>Insert -- lower mount clevis pin, -- |

Signed and Sealed this
Twenty-fourth Day of June, 2014

Michelle K. Lee

Michelle K. Lee
*Deputy Director of the United States Patent and Trademark Office*